US006321459B1

(12) United States Patent
Mastrangelo

(10) Patent No.: US 6,321,459 B1
(45) Date of Patent: Nov. 27, 2001

(54) DEVICE FOR ASSISTING A USER TO DRAW A TOPOGRAPHICAL CONTOUR MAP

(76) Inventor: Mitchell R. Mastrangelo, 3 Marjorie Way, Hamilton Square, NJ (US) 08690-2722

( * ) Notice: Subject to any disclaimer, the term of this patent is extended or adjusted under 35 U.S.C. 154(b) by 0 days.

(21) Appl. No.: 09/533,292

(22) Filed: Mar. 22, 2000

(51) Int. Cl.[7] ..... B43L 13/00

(52) U.S. Cl. ..... 33/664; 33/454; 33/1 F; 33/1 G

(58) Field of Search ..... 33/664, 1 F, 1 G, 33/1 K, 454, 520, 644, 663; 434/90, 91, 203, 204; 116/321, 322, 323, 324

(56) References Cited

U.S. PATENT DOCUMENTS

| | | | | |
|---|---|---|---|---|
| 235,225 | * | 12/1880 | Fulton | 33/664 |
| 344,014 | | 6/1886 | Stevenson . | |
| 663,053 | * | 12/1900 | Wangler | 33/663 |
| 785,756 | | 3/1905 | Nutz . | |
| 2,325,231 | * | 7/1943 | Curtis | 116/323 |
| 2,589,525 | | 3/1952 | Absher . | |
| 3,427,722 | | 2/1969 | Ingram . | |
| 4,601,108 | | 7/1986 | Swanson . | |
| 5,331,919 | * | 7/1994 | Root et al. | 116/323 |

FOREIGN PATENT DOCUMENTS

| | | | | |
|---|---|---|---|---|
| 345507 | * | 12/1921 | (DE) | 33/454 |

* cited by examiner

*Primary Examiner*—Andrew H. Hirshfeld
(74) *Attorney, Agent, or Firm*—Watov & Kipnes, P.C.

(57) ABSTRACT

A device for use in plotting equal spacings over a distance includes a frame comprising opposed first and second pairs of frame members with each frame member having opposed ends and pivotal connecting means for pivotally connecting adjacent frame members at respective ends thereof. Each of the first pair of frame members includes a plurality of longitudinally spaced-apart apertures disposed along its respective length. The device further includes a flexible linear member placed continuously through the apertures of said first pair of frame members to provide a plurality of parallel equally spaced apart linear elements which are disposed in substantially parallel relation with each other and with the second pair of frame members, and a marker element being slidably attached to each of the plurality of linear elements.

9 Claims, 1 Drawing Sheet

DEVICE FOR ASSISTING A USER TO DRAW A TOPOGRAPHICAL CONTOUR MAP

FIELD OF THE INVENTION

The present invention generally relates to a device for assisting a user to draw a topographical contour map, more particularly to devices for use in indicating equal spacings between two terminal points of a line or distance so that a topographical contour map may be accurately drawn therefrom.

BACKGROUND OF THE INVENTION

When using the stadia method (the plotting of points) of making a topographical contour map, engineers and surveyors have experienced difficulty in precisely drawing the lines or contours necessary to provide an accurate display of the topography of a finite parcel of land. In particular, the topographical lines are drawn based on a series of points plotted in generally a minimum of three directions. The plotted points each represent a certain elevational unit or elevation (e.g. 1 foot). Interpolation is necessary to precisely position the contour lines, especially when the total elevation requires a fraction of a unit. Although certain devices have been developed for the purpose of addressing the problem, the prior art devices are generally expensive, bulky, and difficult to use.

It would be of significant advance in the art of producing topographical contour maps to develop a device having a durable, compact construction and design which facilitates the positioning of points to enable the drawing of accurate, low-cost topographical contour maps.

SUMMARY OF THE INVENTION

The present invention is generally directed to a device for assisting a user in drawing a topographical contour map through the plotting of multipoints in multiple directions comprised of a frame including opposed first and second pairs of frame members where each of the frame members has ends that are pivotally connected to the ends of adjacent frame members so that the frame be readily moved to assume a variety of parallelogram shapes, and a plurality of equally spaced-apart linear elements extending between the first pair of frame members wherein the distance between the spaced apart elements changes as the shape of the parallelogram changes. The shape of the frame and therefore the distance between the linear elements may be adjusted to plot points for the formation of contour lines on a topographical contour map regardless of the steepness of the grade of elevation. The device enables the points to be plotted in a manner which is visually easy to read. The device is also portable with a durable construction.

In one aspect of the present invention there is provided a device for assisting in the formation of a topographical contour map which comprises:

a frame including opposed first and second pairs of frame members with each frame member having opposed ends;

pivotal connecting means for pivotally connecting adjacent frame members at respective ends thereof; and a plurality of equally spaced-apart linear elements extending between the first pair of frame members with alternate linear elements being distinguishable from adjacent linear elements.

In another aspect of the present invention, the device comprises:

a frame including opposed first and second pairs of frame members with each frame member having opposed ends;

pivotal connecting means for pivotally connecting adjacent frame members at respective ends thereof;

a plurality of longitudinally spaced apart apertures disposed along the length of each of the first pair of frame members;

a single linear member being continuously placed through the apertures to provide a plurality of parallel equally spaced apart linear elements which are disposed in substantially parallel relation with each other and with the second pair of frame members; and a marker element being slidably attached to each of the plurality of linear elements.

BRIEF DESCRIPTION OF THE DRAWINGS

The following drawings in which like reference characters indicate like parts are illustrative of embodiments of the invention and are not to be construed as limiting the invention as encompassed by the claims forming part of the application.

DETAILED DESCRIPTION OF THE INVENTION

Figures 1, 2, 3:
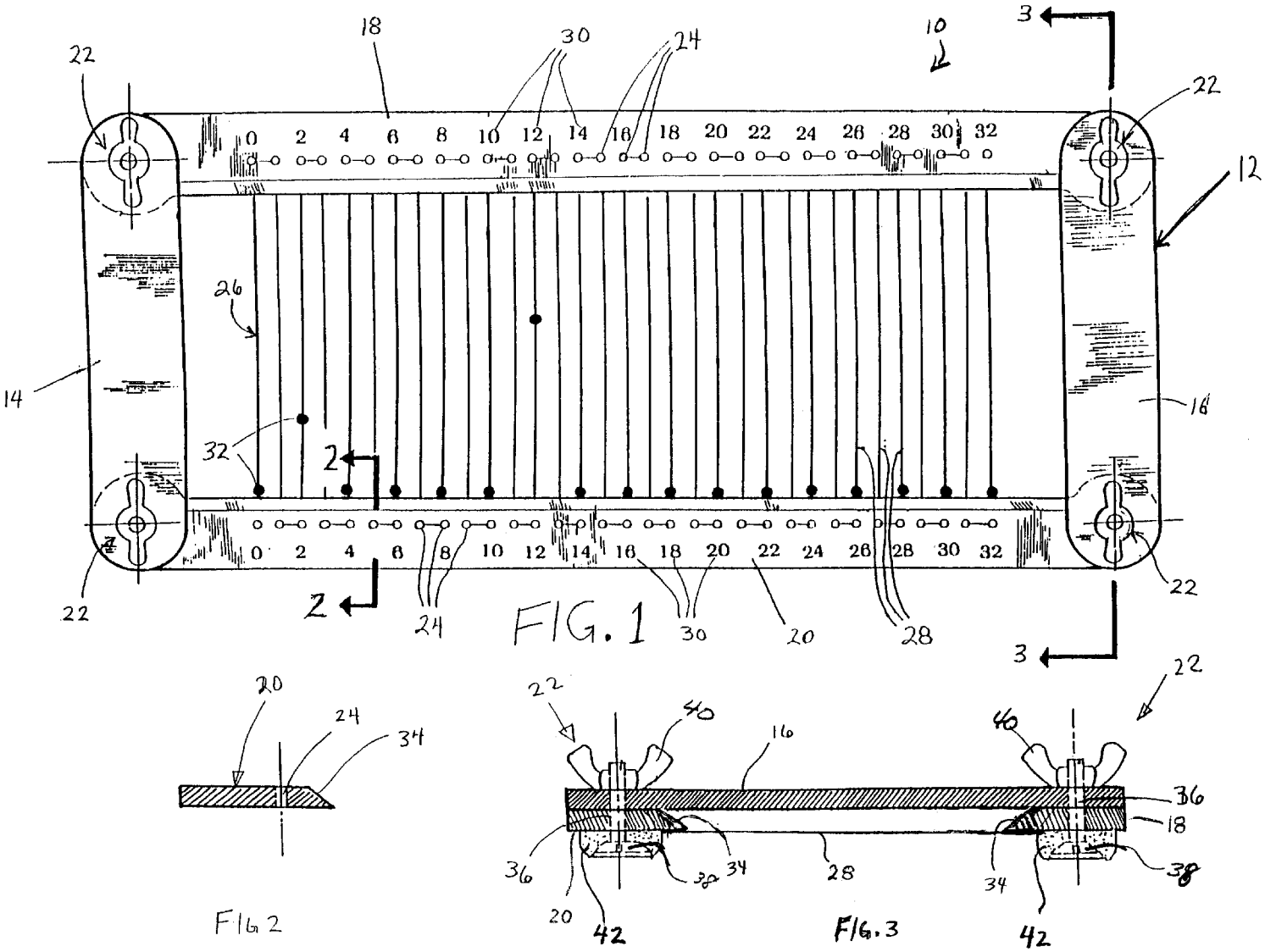
FIG. 1 is a top plan view of one embodiment of the device of the present invention.
FIG. 2 is a cross sectional view of the device taken along 2—2 in FIG. 1.
FIG. 3 is a cross sectional view of the device taken along 3—3 in FIG. 1.

The present invention is generally directed to a device for assisting the user in drawing a topographical contour map. The device is constructed in a manner that provides a simple and inexpensive tool for plotting points to facilitate the formation of topographical contour maps and other graphical representations. The device is easy to use and affords accurate plotting which enables the drawing of topographical contour maps which precisely depict the contour or elevation of a finite parcel of land. The device is portable and compact making it especially useful for engineers and surveyors working on-site under various lighting and weather conditions. In addition, the device may be constructed in a manner which allows the user to carry the device is the pocket.

Referring to FIG. 1, a device 10 is illustrated for one embodiment of the invention. The device 10 includes a frame 12 having a general parallelogram shape where the angles of the parallelogram can change as hereinafter described. The frame 12 has a pair of opposed generally shorter frame members 14 and 16 pivotally connected to another pair of opposed generally longer frame members 18 and 20 at their respective ends by a pivot assembly 22. The frame members 14, 16, 18 and 20 and the pivot assemblies 22 may be constructed of any suitable durable, rigid material such as metal, wood, plastic, carbon composite, and the like, which can withstand the rigors of constant flexing and pivot movement. The frame members 18 and 20 further include a plurality of longitudinally spaced apart apertures 24 which are used to house and align linear members as hereinafter described. The plurality of spaced apart apertures 24 are axially aligned with the center of the adjacent pivot assemblies 22 between the frame members 14, 16, 18 and 20 of the frame 12.

A single, flexible linear member 26 is threaded alternately between each member 18, 20 beginning at the endmost aperture and continuing successively through corresponding apertures 24 to provide a plurality of parallel equally spaced linear elements 28. The linear member 26 may include, but is not limited to, thread, fiber, string, cord, wire made of metal, plastics, and the like. In this embodiment, the device 10 includes thirty-three linear elements 28 which are spaced apart by 3/16 inch when the frame 12 is straight and squared. It will be understood that the number of and the distance between the linear elements 28 may be varied as desired by the modifying the number and spacing of the apertures 24 in the device 10.

The opposite ends of the linear member 26 may be securely anchored by knots (not shown) which are larger than the diameter of the apertures 24. It will be understood that other means for anchoring of the ends may be used. As shown in FIG. 1, one end of the linear member 26 is anchored on one member 20 and the other end of the linear member 26 is anchored on the other opposed member 18.

It will be noted that, when each member 14,16,18,20 of the frame 12 is arranged in substantially right angular relation with an adjacent member, the spacing between the linear elements 28 is at its maximum. However, when adjacent frame members are shifted out of right angular relationship with respect to each other, the distance between the linear elements 28 will progressively decrease.

To divide a given distance or line into a number of equal spaces, the frame 12 of the device 10 is adjusted until the outermost two linear elements, which encompasses a number of linear elements therebetween, are in alignment with terminal points of the distance or line to be divided. Smaller spaces are obtained by partially closing the frame 12 or shifting the frame 12 so that adjacent frame members are progressively shifted away from right angular relation. Therefore, for example, if a line or a distance is to be divided by the device 10 into ten equal spaces, the spacing is accomplished by shifting the frame 12 until the outermost linear elements 28 encompassing nine linear elements 28 therebetween, are in alignment with the respective ends of the line. It will be understood that if a line or distance to be divided is greater than the distance between the two outermost linear elements 28 when the frame 12 is in its fully opened position, then the frame 12 may be shifted so that the linear elements 28 are shifted from a normal or perpendicular relation with respect to the frame members to a more angular position with these frame members. This reduces the spacing between adjacent linear elements to permit a larger number of linear elements 28 to be utilized in dividing the line or distance into equal increments.

As to using the device 10 for drawing topographical contour maps, a map indicated with a series of vertically and horizontally running grid lines may be utilized. However, it will be understood that maps without grid lines may also be used with the device 10. Through known methods of surveying land, the user can determine the corresponding elevations at select points on the map, for example, at the points intersected by the grid lines. The user begins by selecting two neighboring known elevation points. Knowing the difference in elevation between the two elevation points, the user determines the number of linear elements 28 of device 10 needed for plotting one or more intermediate elevation points, for example, selecting one linear element 28 for each unit change in elevation. The frame 12 of the device 10 is then adjusted until the two outermost linear elements 28, which encompasses the selected number of linear elements 28 therebetween, are respectively in alignment with the two known elevation points on the map. The user marks off the intermediate elevation points as indicated by each linear element 28. The process is repeated throughout the grid or area of the map for plotting the intermediate elevation points. Upon completion, the user draws the contour lines through the associated elevation points as plotted.

Referring again to FIG. 1, each of the frame members 18 and 20, further includes a sequence of numbered markings 30, each of which corresponds to an associated aperture 24 and linear element 28. The markings 30 provide a visually efficient way of counting off the number of linear elements 28 that the user may need to plot which provides better accuracy and speed. Rather than physically counting each linear element 28 which may introduce error and slow the plotting, the user simply glances at the desired number and then look to the linear element 28 immediate to the number marking 30.

The plurality of linear elements 28 may further include alternate linear elements 28 being distinguishable from adjacent linear elements 28. This effect may be accomplished by generating a visually distinctive scheme which alternates between each linear element 28. Such visually distinctive schemes may include color coding each linear element 28 alternately between two contrasting colors, for example, providing the user with a facilitated means for visually pinpointing a specific linear element 28 during the plotting process. In a preferred embodiment, the plurality of linear elements 28 may include a red and white color scheme for providing improved visual distinguishment. It will be appreciated that other alternating visually distinctive schemes may be used as desired such as using different surface textures, translucence, visual patterns, and the like.

As shown in FIG. 1, all or some of the linear elements 28 may include a marker element 32 slidably connected thereto as shown specifically in FIG. 1 where a marker element 32 is provided on alternating linear elements 28. The marker element 32 is configured to selectively slide along the length of the corresponding linear element 28. The marker elements 28 of the outermost linear elements 28 may be positioned over the corresponding terminal points for better visibility and ease of use. The marker elements 28 provides the user with a rapid means for ensuring that the device 10 is correctly aligned with terminal points of the distance to be divided and that the correct number of linear elements 28 is apportioned thereto.

Referring to FIG. 2, a cross sectional view of the member 20 is shown. The edge portion 34 proximate to the apertures 24 is tapered for permitting the user to easily match the numbered markings 30 with the corresponding ends of the linear elements 28 from various perspective views. The opposed member 18 includes the same cross sectional profile as member 20.

Referring to FIG. 3, a cross sectional view of the assembled frame members 16, 18 and 20 is shown with the plurality of linear elements 28 extending between the frame members 18 and 20. The pivot assembly 22 comprises a machine screw 38 which extends through a washer 42 and an opening 36 in each of the associated frame members 14, 16, 18, and 20, and a wing nut 40 threadedly engaged with the machine screw 38. The wing nuts 40 may be tightened to generate a frictional engagement of the contacting faces between each member 14, 16, 18, 20 and permit the device 10 to be remained in an adjusted position. Alternatively, a nut and bolt assembly may be used for the pivot assembly 22. The coefficient friction of the suitable durable, rigid material employed permits the frame members to be retained in a selected position until forcibly shifted to a new position.

However, the pivot assembly 22 is not limited to the arrangements described above and may include other mechanisms and devices which permit selective swivel movement between the frame members of the frame, as known to one of ordinary skill in the art. It is preferable to overlap the frame members 14 and 16 over the opposed pairs of frame members 18 and 20, thereby minimizing the distance between the plurality of linear elements 28 and the plotting surface for better accuracy and precision.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A device for assisting in the formation of a topographical contour map, said device comprising:

a frame including opposed first and second pairs of frame members with each frame member having opposed ends;

pivotal connecting means for pivotally connecting adjacent frame members at respective ends thereof;

a plurality of longitudinally spaced apart apertures disposed along the length of each of the first pair of said frame members;

a single linear member continuously placed through the apertures of said first pair of frame members to provide a plurality of parallel equally spaced apart linear elements which are disposed in substantially parallel relation with each other and with the second pair of frame members; and a marker element being slidably attached to each of the plurality of linear elements.

2. The device of claim 1, wherein each of said plurality of linear elements are alternately distinguishable from adjacent ones of said linear elements.

3. The device of claim 2, wherein the alternating linear elements, are of different color than the adjacent linear elements.

4. The device of claim 1, wherein said plurality of linear elements are spaced-apart by 3/16" when the adjacent frame members are oriented perpendicularly to one another.

5. The device of claim 1, wherein the number of said plurality of longitudinally spaced-apart apertures in each of said first pair of frame members is thirty-three.

6. The device of claim 10, wherein said first pair of frame members further include a sequence of numerical markings, each numerical marking representing sequentially each said plurality of linear elements.

7. The device of claim 1, wherein said linear member is made of a material selected from the group consisting of thread, fiber, string, cord, and wire.

8. The device of claim 1, wherein the number of linear elements is at least twelve.

9. The device of claim 1, wherein said first and second pairs of frame members are each made of a durable, rigid material selected from the group consisting of wood, plastic, metal, and carbon composite.

* * * * *